US011746770B2

(12) United States Patent
Mou et al.

(10) Patent No.: US 11,746,770 B2
(45) Date of Patent: Sep. 5, 2023

(54) GAS TRANSPORTATION DEVICE

(71) Applicant: Microjet Technology Co., Ltd., Hsinchu (TW)

(72) Inventors: Hao-Jan Mou, Hsinchu (TW); Shih-Chang Chen, Hsinchu (TW); Chi-Chang Yang, Hsinchu (TW); Yung-Lung Han, Hsinchu (TW); Chi-Feng Huang, Hsinchu (TW); Chang-Yen Tsai, Hsinchu (TW); Chun-Yi Kuo, Hsinchu (TW)

(73) Assignee: Microjet Technology Co., Ltd., Hsinchu (TW)

( * ) Notice: Subject to any disclaimer, the term of this patent is extended or adjusted under 35 U.S.C. 154(b) by 0 days.

(21) Appl. No.: 17/586,973

(22) Filed: Jan. 28, 2022

(65) Prior Publication Data

US 2023/0167816 A1 Jun. 1, 2023

(30) Foreign Application Priority Data

Nov. 29, 2021 (TW) ..... 110144450

(51) Int. Cl.
*F04B 43/04* (2006.01)

(52) U.S. Cl.
CPC ..... *F04B 43/046* (2013.01)

(58) Field of Classification Search
CPC .. F04B 43/046; F04B 45/047; F04B 53/1067; F04B 53/16
See application file for complete search history.

(56) References Cited

U.S. PATENT DOCUMENTS 4,039,002 A * 8/1977 Broyan ..... F04B 39/108 137/516.17
10,697,450 B2 6/2020 Tanaka et al.
2002/0127736 A1* 9/2002 Chou ..... B01L 3/502738 422/504

(Continued)

FOREIGN PATENT DOCUMENTS

CN 107923385 B 1/2020
CN 112789407 A 5/2021
GB 2557088 A 6/2018

OTHER PUBLICATIONS

Extended European Search Report for European Application No. 22153878.8, dated Jun. 22, 2022.

*Primary Examiner* — Connor J Tremarche
(74) *Attorney, Agent, or Firm* — Birch, Stewart, Kolasch & Birch, LLP

(57) ABSTRACT

A gas transportation device is provided and includes an outer housing, a valve body and an actuator. The outer housing includes an outlet cover, an outlet end, an accommodation space, an inlet cover, and an inlet end. The valve body is in a circular shape and includes a gas outlet plate, a valve plate and a first plate stacked sequentially and disposed within the accommodation space. The actuator is in a circular shape, stacked and disposed on the valve body, includes a second plate, a frame and an actuating component. When the actuator is driven, through the structure of misalignment of the first orifices and the valve openings, the valve body is operated to open a flow path when an airflow is in a forward direction, and the valve body is operated to seal the flow path when the airflow is in a reverse direction.

21 Claims, 10 Drawing Sheets

(56) References Cited

U.S. PATENT DOCUMENTS

| | | | | |
|---|---|---|---|---|
| 2013/0276906 | A1* | 10/2013 | Locke | F16K 15/14 137/15.01 |
| 2017/0218949 | A1 | 8/2017 | Yokoi et al. | |
| 2018/0187672 | A1* | 7/2018 | Tanaka | F04B 43/02 |
| 2019/0056367 | A1* | 2/2019 | Mou | H05K 5/065 |
| 2019/0226472 | A1* | 7/2019 | Tanaka | F04B 39/10 |
| 2019/0353157 | A1* | 11/2019 | Mou | F16K 99/0057 |
| 2020/0318630 | A1* | 10/2020 | Kondo | F04B 43/046 |

* cited by examiner

100

5

GAS TRANSPORTATION DEVICE

FIELD OF THE INVENTION

The present disclosure relates to a gas transportation device, and more particularly to a high-flow gas transportation device.

BACKGROUND OF THE INVENTION

Currently, in various fields, such as pharmaceutical industries, computer techniques, printing industries or energy industries, the products are developed toward elaboration and miniaturization. The gas transportation devices are important components that are used in, for example, micro pumps, micro atomizers, printheads or the industrial printers. Therefore, how to utilize an innovative structure to break through the bottleneck of the prior art has become an important issue of development.

With the rapid development of science and technology, the applications of gas transportation devices are becoming more and more diversified. For example, gas transportation devices are gradually popular in industrial applications, biomedical applications, medical care applications, electronic cooling applications and so on, or even the wearable devices. It is obvious that the gas transportation devices gradually tend to miniaturize the structure and maximize the flow rate thereof.

However, although the current gas transportation device tends to maximize the flow rate, the main structural design object thereof is to prevent the backflow and generate a unidirectional airflow. Therefore, how to provide a high-flow gas transportation device becomes an important research and development topic of the present disclosure.

SUMMARY OF THE INVENTION

An object of the present disclosure is to provide a gas transportation device including a gas outlet plate, a valve plate, a first plate, a second plate and a circular actuating component, which are sequentially stacked and assembled. A valve body is configured by the valve plate, the first plate and the second plate collaboratively. When an airflow is in the forward direction, the valve body is operated to open a flow path, and when the airflow is in the reverse direction, the valve body is operated to seal the flow path, thereby the phenomenon of backflow can be effectively prevented to generate a unidirectional airflow and obtain a high-flow gas transportation device.

In accordance with an aspect of the present disclosure, a gas transportation device including an outer housing, a valve body and an actuator is provided. The outer housing includes an outlet cover, an outlet end, an accommodation space, an inlet cover and an inlet end. The outlet cover is disposed on the outer housing, the outlet cover includes the outlet end, the inlet cover is disposed below the outer housing, the inlet cover includes the inlet end, the accommodation space is in fluid communication with the inlet end and the outlet end, and the outlet cover and the inlet cover are covered on an upper side and a lower side of the accommodation space, respectively. The valve body is in a circular shape and includes a gas outlet plate, a valve plate and a first plate sequentially stacked and disposed within the accommodation space. The first plate includes a recessed portion recessed from a surface thereof and formed a depth, the valve plate is located between the gas outlet plate and the first plate, and a gap is maintained between the valve plate and the recessed portion of the first plate, so as to allow the valve plate to displace in the gap and control a flow path in the valve body. The gas outlet plate includes a plurality of outlet apertures, the first plate includes a plurality of first orifices, the valve plate includes a plurality of valve openings, the plurality of valve openings are misaligned with the plurality of first orifices, and the plurality of valve openings are corresponding in position to the plurality of outlet apertures. The actuator in a circular shape is stacked on the valve body, and includes a second plate, a frame and an actuating component, wherein the second plate is stacked and disposed on the first plate of the valve body, the second plate includes a plurality of second orifices, and the plurality of second orifices are corresponding in position to the plurality of first orifices. The frame is stacked and disposed on the second plate. The actuating component is stacked and disposed on the frame. When the actuator is driven, through the misalignment of the plurality of first orifices and the plurality of valve openings, the valve body is operated to open the flow path when an airflow is in a forward direction, and the valve body is operated to seal the flow path when the airflow is in a reverse direction.

BRIEF DESCRIPTION OF THE DRAWINGS

The above contents of the present disclosure will become more readily apparent to those ordinarily skilled in the art after reviewing the following detailed description and accompanying drawings, in which.

DETAILED DESCRIPTION OF THE PREFERRED EMBODIMENT

Figure 1A:
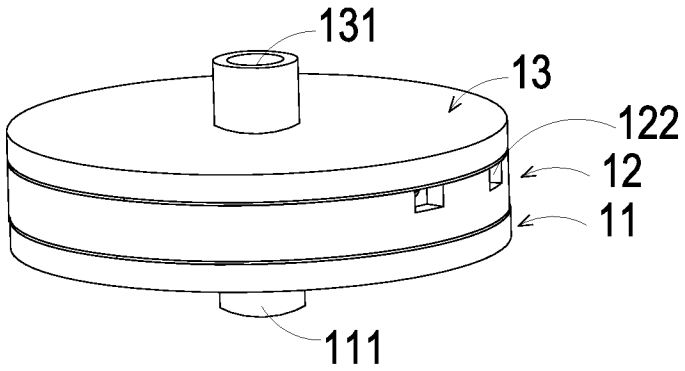
FIG. 1A is a schematic exterior view illustrating a gas transportation device according to an embodiment of the present disclosure.
Figure 1B:
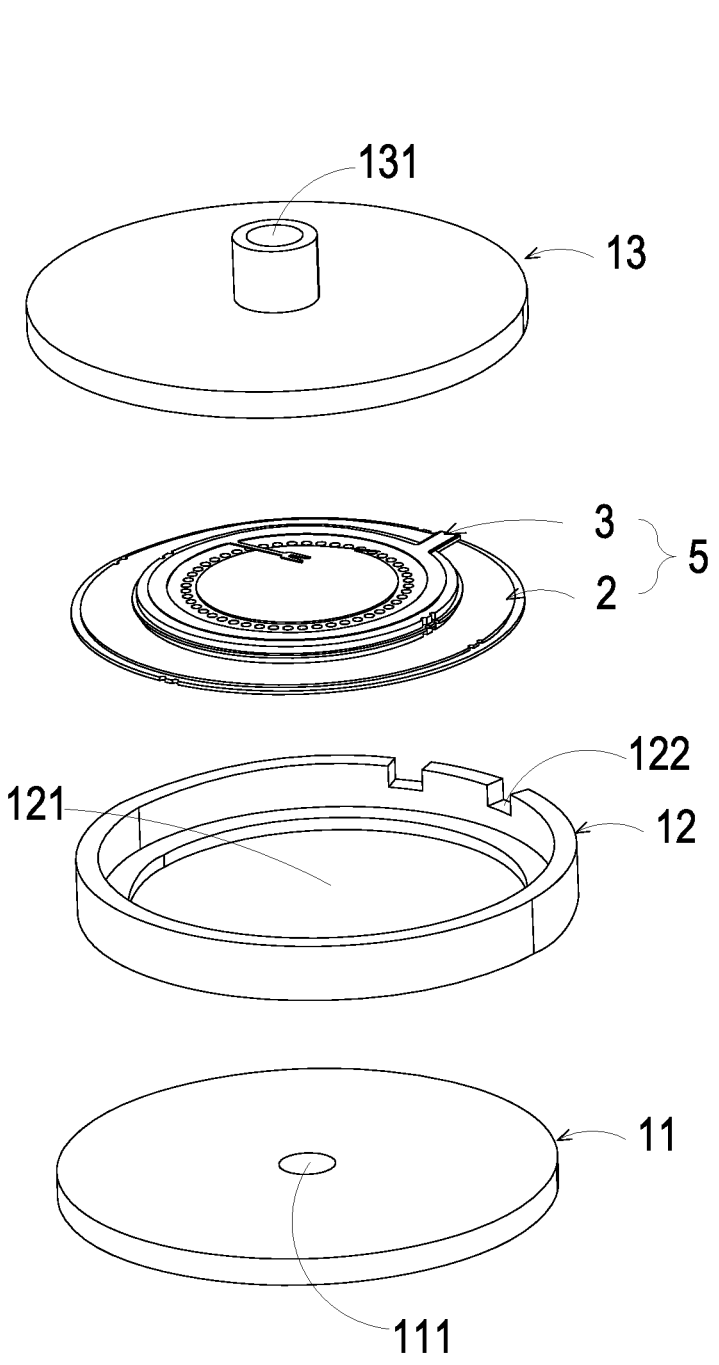
FIG. 1B is a schematic exploded view illustrating the gas transportation device according to the embodiment of the present disclosure.

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

The present disclosure provides a gas transportation device 100. Please refer to FIG. 1A, FIG. 1B, FIG. 2A, FIG. 2B and FIG. 2C. In the embodiment, the gas transportation device 100 includes an outer housing 12, a valve body 2 and an actuator 3. The outer housing 12 includes an outlet cover 11, an outlet end 111, an accommodation space 121, an inlet cover 13 and an inlet end 131. The outlet cover 11 is disposed on the outer housing 12. The outlet cover 11 includes the outlet end 111. The inlet cover 13 is disposed below the out housing 12. The inlet cover includes the inlet end 131. The accommodation space 121 is in fluid communication with the inlet end 131 and the outlet end 111. Moreover, the outlet cover 11 and the inlet cover 13 are covered on an upper side and a lower side of the accommodation space 121, respectively. Notably, preferably but not exclusively, the outlet cover 11, the outer housing 12 and the inlet cover 13 are in a circular shape or in a square sharp. In other embodiments, the shape of the outlet cover 11, the outer housing 12 and the inlet cover 13 are adjustable according to the design requirements.

For the convenience of description, the outlet cover 11, the outer housing 12 and the inlet cover 13 in the circular shape are given and described in the following embodiments as an example. In the embodiment, the outlet cover 11, the outer housing 12 and the inlet cover 13 are in the form of a circular box, which includes an outlet end 111, an inlet end 131 and an accommodation space 121. The outlet end 111 and the inlet end 131 are located at two opposite sides of the outer housing, and in fluid communication with the accommodation space 121.

Please refer to FIG. 1, FIG. 1B and FIGS. 2A to 2C. In the embodiment, the valve body 2 is in a circular shape and includes a gas outlet plate 21, a valve plate 22 and a first plate 23, which are stacked sequentially and disposed within the accommodation space 121. The first plate 23 includes a recessed portion 232 recessed from a surface thereof and formed a depth. The valve plate 22 is located between the gas outlet plate 21 and the recessed portion 232 of the first plate 23. Moreover, a gap G is maintained between the valve plate 22 and the recessed portion 232 of the first plate 23, so as to allow the valve plate 22 to displace in the gap G and control a flow path therein. In the embodiment, the gas outlet plate 21 includes a plurality of outlet apertures 211, and the first plate 23 includes a plurality of first orifices 231, and the valve plate 22 includes a plurality of valve openings 221. The plurality of valve openings 221 are misaligned with the plurality of first orifices 231, and the plurality of valve openings 221 are corresponding in position to the plurality of outlet apertures 211.

In the embodiment, the valve body 2 includes the gas outlet plate 21, the valve plate 22 and the first plate 23 stacked sequentially and disposed within the accommodation space 121, and the valve plate 22 is located between the gas outlet plate 21 and the first plate 23. Preferably but not exclusively, in this embodiment, the gas outlet plate 21 and the first plate 23 are a metallic plate, respectively. In the embodiment, the valve plate 22 is a flexible membrane, and the thickness of the valve plate 22 is ranged from 0.4 μm to 0.6 μm, and most preferably, the thickness of the valve plate 22 is 0.5 μm. Preferably, but not exclusively, the valve plate 22 is a polyimide membrane.

In the embodiment, the gas outlet plate 21 includes a plurality of outlet apertures 211, and the first plate 23 includes a plurality of first orifices 231, and the valve plate 22 includes a plurality of valve openings 221. The plurality of valve openings 221 are misaligned with the plurality of first orifices 231, so that the valve plate 22 is allowed to seal the plurality of first orifices 231. In the embodiment, the plurality of valve openings 221 are corresponding in position to the plurality of outlet apertures 211, and the diameter d2 of the valve opening 22 is greater than or equal to the diameter d1 of the outlet aperture 211. With such aperture design of the outlet aperture 211, a high-flow airflow passes through the valve openings 221 when the valve body 2 is operated to open a flow path, and then discharges out through the outlet aperture 211 rapidly. Moreover, in the embodiment, the first plate 23 includes a recessed portion 232 recessed from a surface thereof and formed a depth, and the valve plate 22 is covered by the first plate 23, so that a gap G is maintained between the valve plate 22 and the recessed portion 232 of the first plate 23. In the embodiment, a ratio of the gap G to the thickness of the first plate 23 is ranged from 1:2 to 2:3. Preferably but not exclusively, the gap G is ranged from 40 μm to 70 μm. Most preferably, in the embodiment, the gap G is 60 μm. With such valve body 2 designed, when the valve plate 22 is shifted towards the first plate 23 and allowed to seal the first orifices 231, the valve body 2 is operated to seal the flow path, as shown in FIG. 3B. Alternatively, when the valve plate 22 is shifted towards the gas outlet plate 21 and allowed to be vibrated in the airflow in the gap G, the valve body 2 is operated to open the flow path, as shown in FIG. 3C, and the airflow (flowing in the path indicated by the arrow) passes through the valve openings 221 and then discharges out through the outlet aperture 211. In this way, the valve body 2 is designed to prevent the phenomenon of backflow, and generate a unidirectional airflow with a high-flow control effect.

Figure 3A:
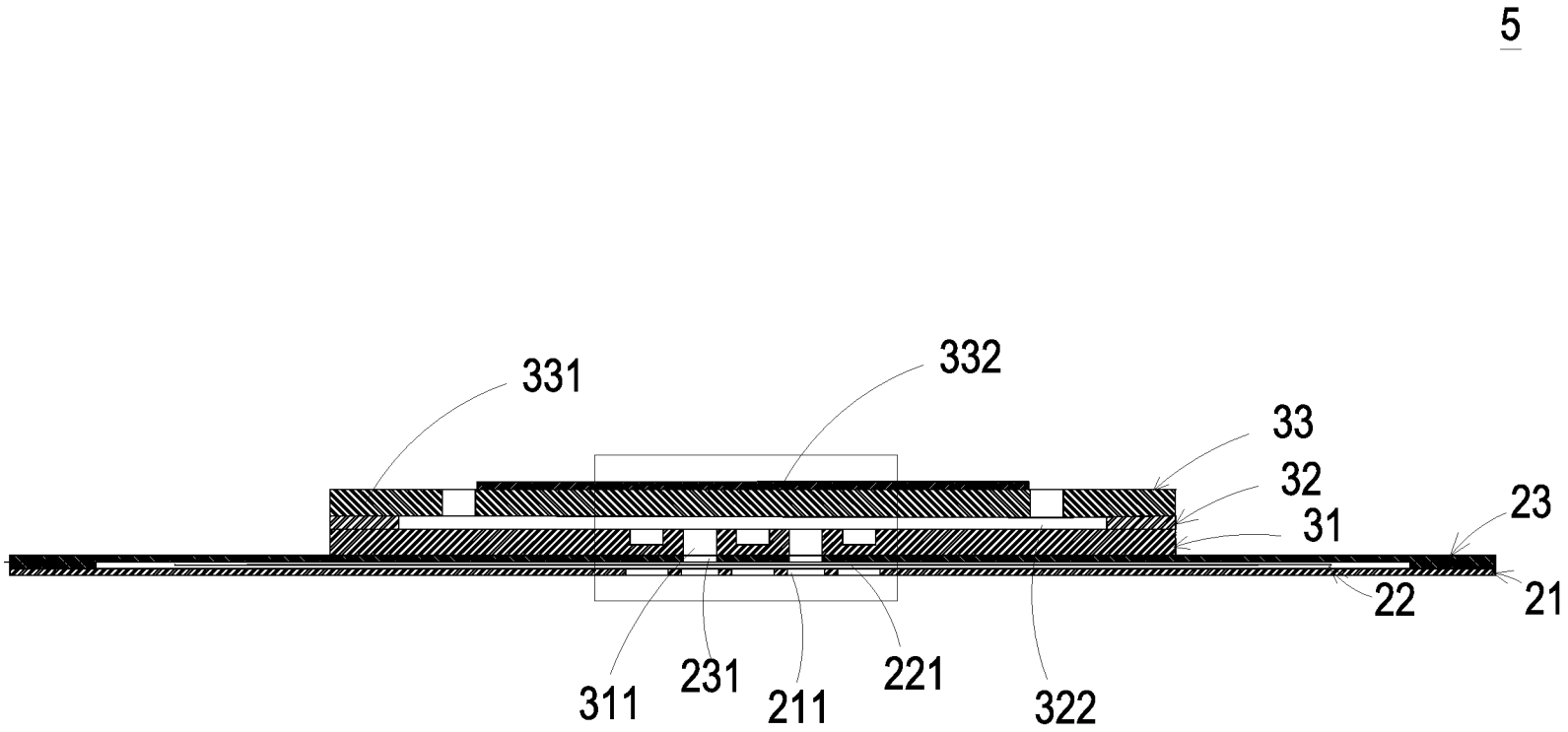
FIGS. 3A to 3C and FIG. 4 are cross sectional views illustrating the operation steps of the gas transportation device according to the embodiment of the present disclosure.
Figure 3B:
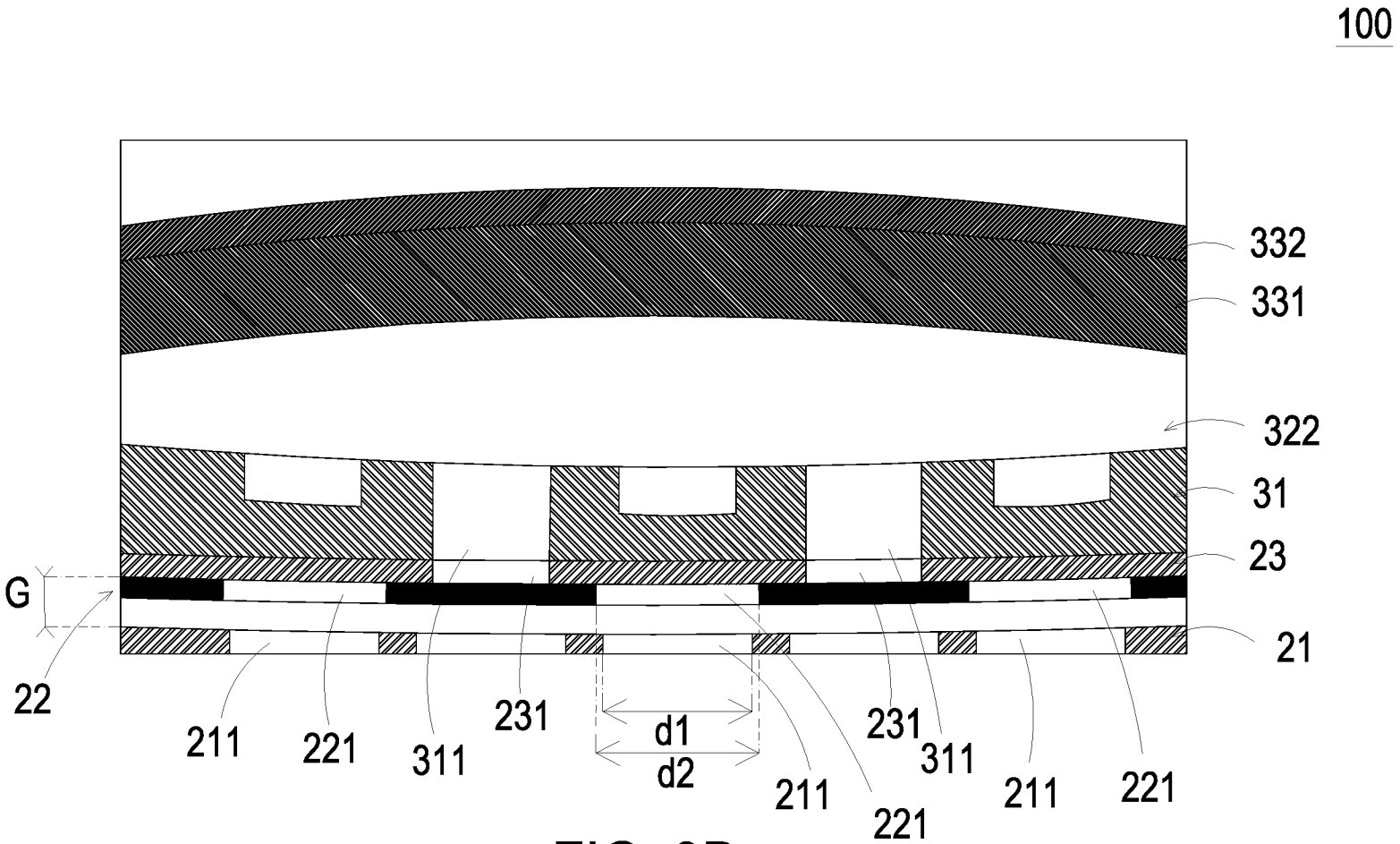
Figure 3C:
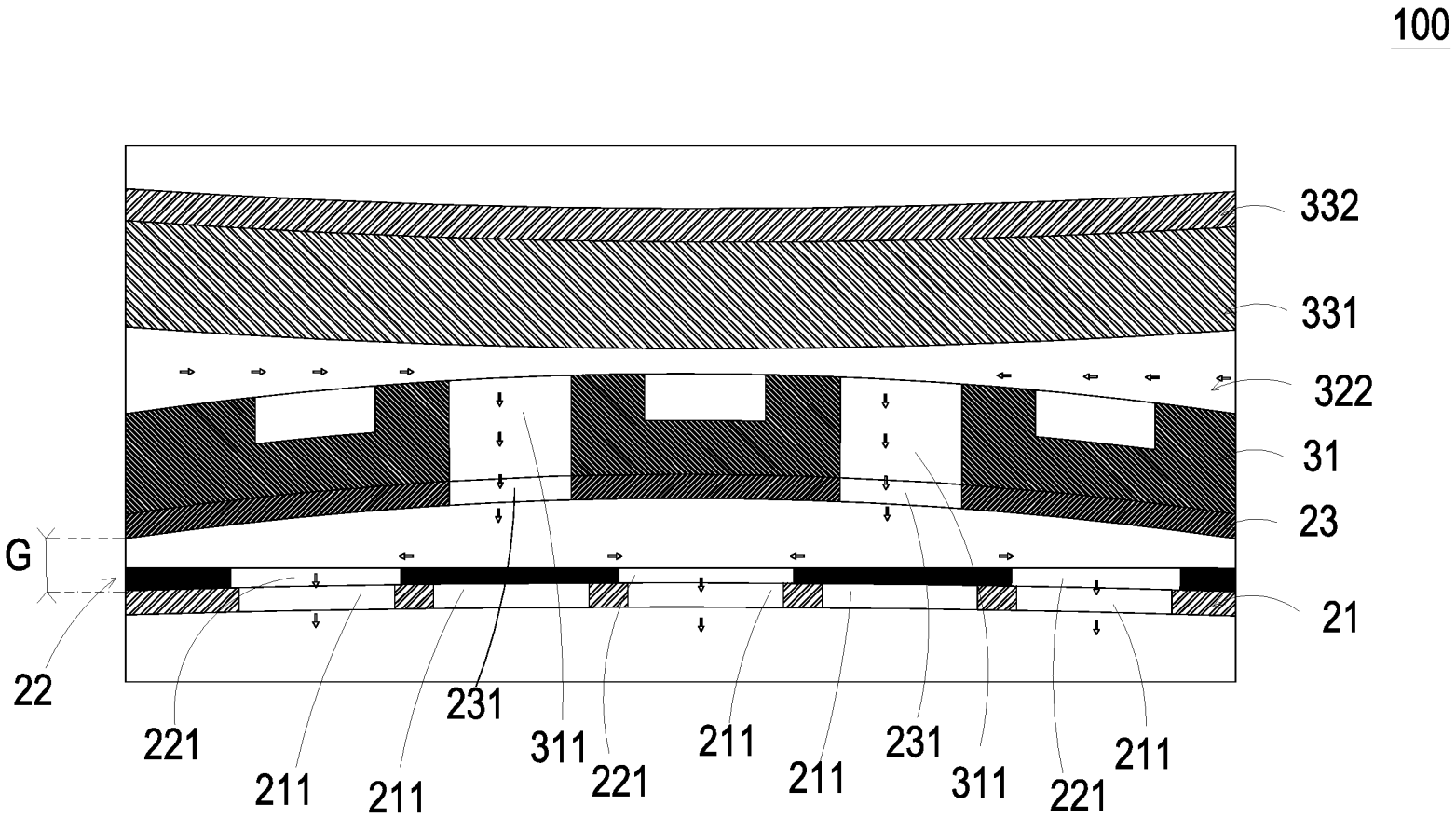

Please refer to FIG. 3A. In the embodiment, the actuator 3 is in a circular shape and stacked on the valve body 2. The actuator 3 includes a second plate 31, a frame 32 and an actuating component 33. The second plate 31 is stacked and disposed on the first plate 23 of the valve body 2. The second plate 31 includes a plurality of second orifices 311, and the plurality of second orifices 311 are corresponding in position to the plurality of first orifices 231. In the embodiment, the frame 32 is stacked and disposed on the second plate 31. Moreover, the actuating component 33 is stacked and disposed on the frame 32. In that, when the actuator 3 is driven, through the misalignment of the plurality of first orifices 231 and the plurality of valve openings 221, the valve body 2 is operated to open a flow path when the airflow is in the forward direction, and the valve body 2 is operated to seal the flow path when the airflow is in the reverse direction.

Figure 1C:
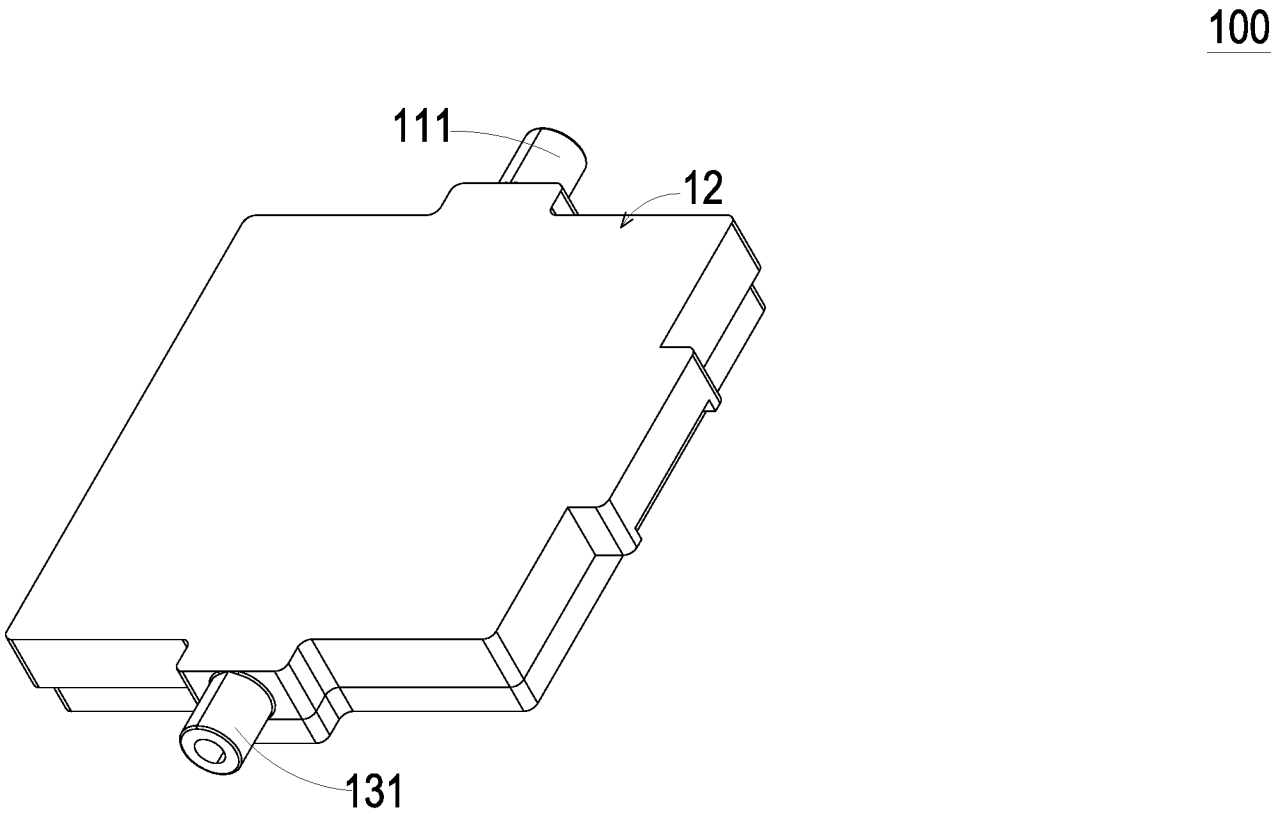
FIG. 1C is a schematic exterior view illustrating a gas transportation device according to a second embodiment of the present disclosure.
Figure 2A:
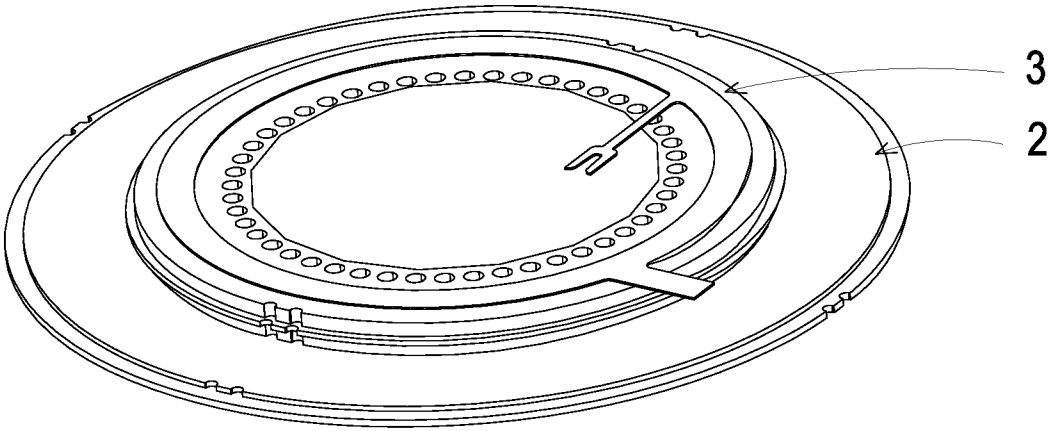
FIG. 2A is a schematic perspective view illustrating the main body of the gas transportation device according to the embodiment of the present disclosure.
Figure 2B:
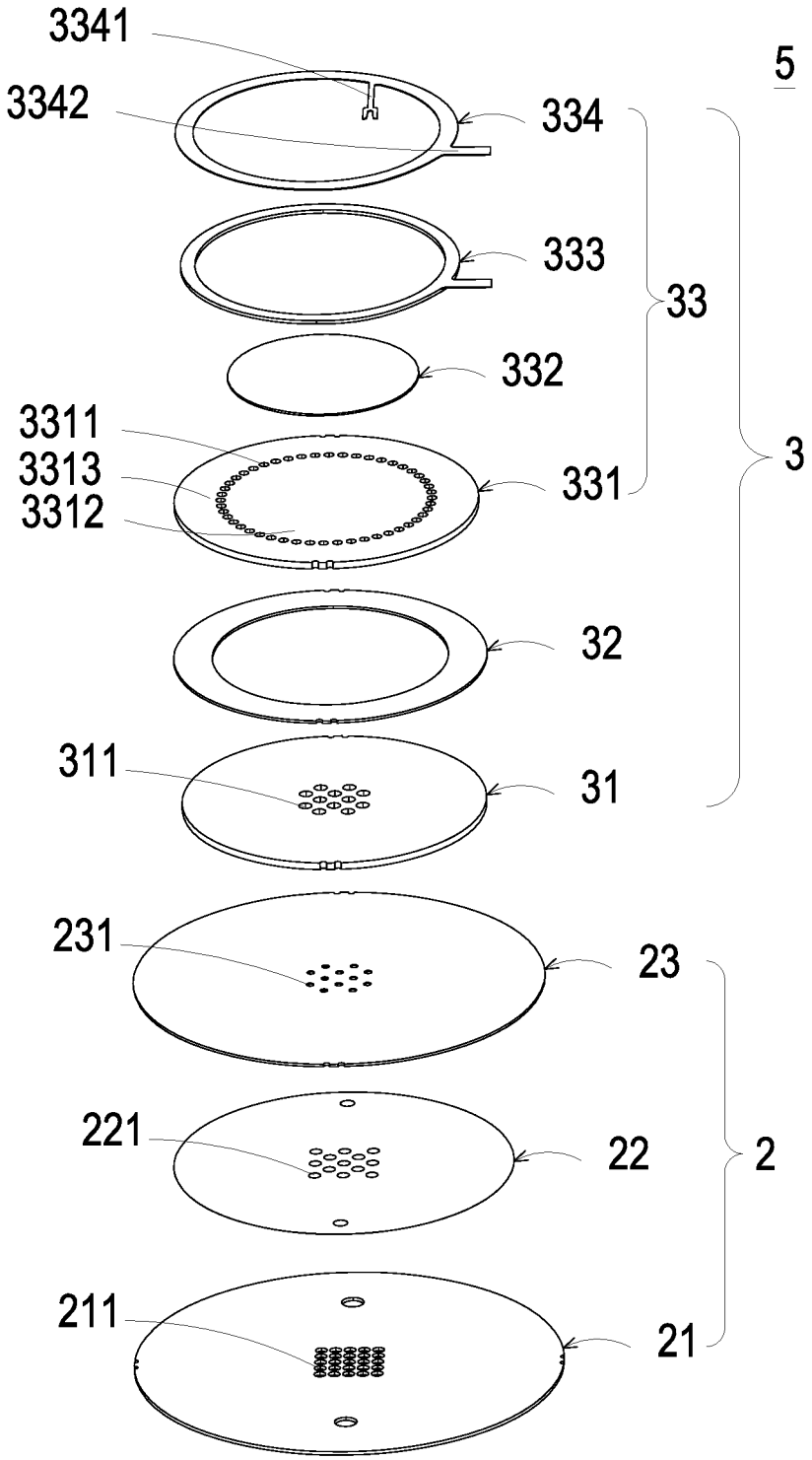
FIG. 2B is a schematic exploded view illustrating the gas transportation device according to the embodiment of the present disclosure and taken from a first viewing angle.
Figure 2C:
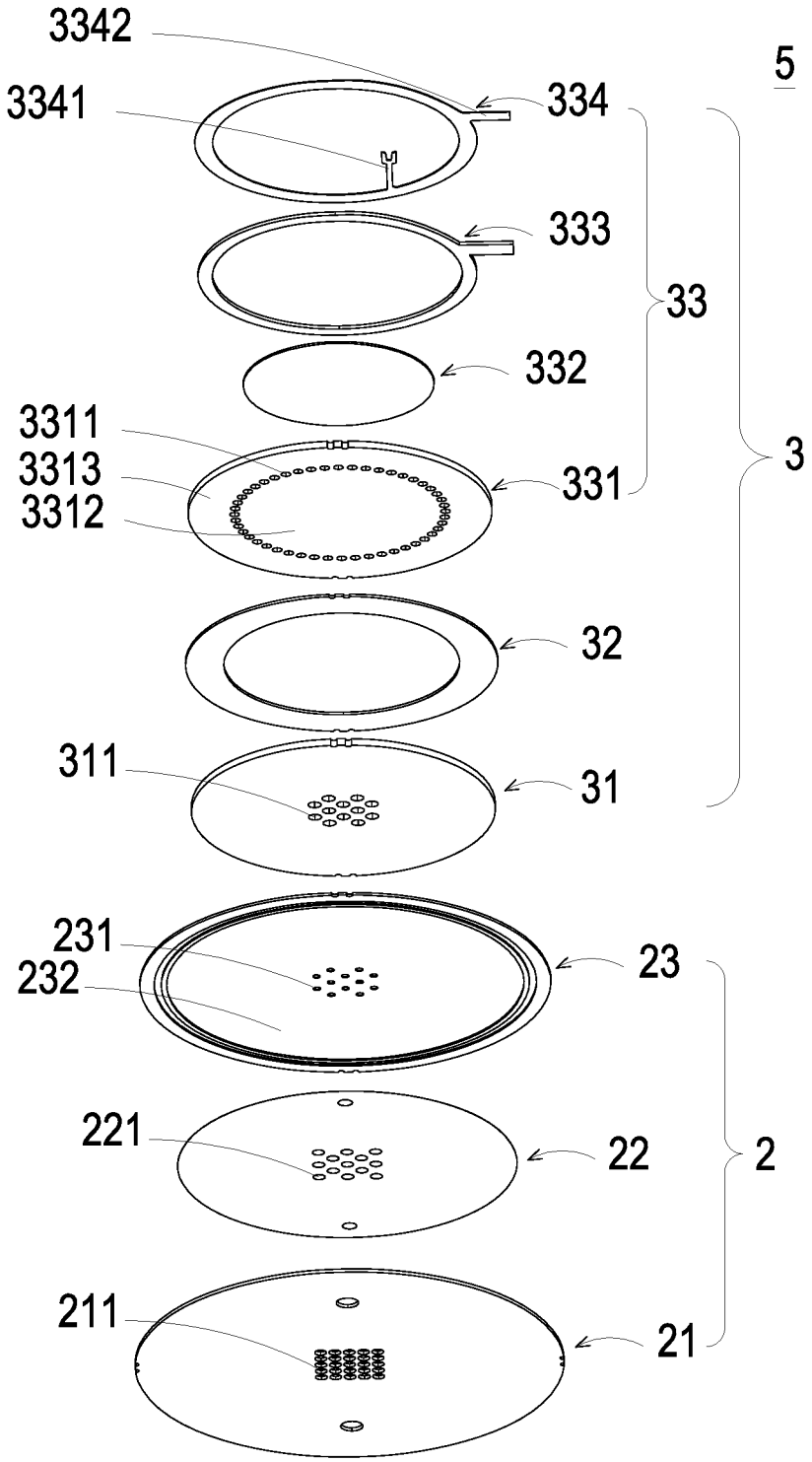
FIG. 2C is a schematic exploded view illustrating the gas transportation device according to the embodiment of the present disclosure and taken from a second viewing angle.

Notably, the combination of the valve body 2 and the actuator 3 is named as the main body 5 of the gas transportation device 100. In the embodiment, the main body 5 is received within the accommodation space 121 of the outer housing 12 in the circular shape, and covered by the circular outlet cover 11 and the circular inlet cover 13, and the sealing port 122 is sealed, but not limited thereto. In another embodiment, the main body 5 of the gas transportation device 100 can also be disposed within a square outer housing 12, as shown in FIG. 1C. In addition, notably, the material for sealing the sealing port 122 is epoxy resin or any other material capable of sealing the sealing port 122.

Furthermore, the actuator 3 includes the second plate 31, the frame 32 and the actuating component 33. In the embodiment, the second plate 31 is fixed and disposed on the first plate 23, and the thickness of the second plate 31 is greater than the thickness of the first plate 23. The second plate 31 includes the plurality of second orifices 311. Notably, the number, the position and the diameter of the second orifices 311 are corresponding to those of the first orifices 231. In the embodiment, the diameter of the second orifices 311 is equal to the diameter of the first orifices 231. In the embodiment, the second plate 31 further includes a contact point (not shown) for the electrical connection of the wires.

Preferably but not exclusively, in the embodiment, the second plate 31 is a metallic plate.

In the embodiment, the frame 32 is disposed and positioned on the second plate 31, and the actuating component 33 is disposed and positioned on the frame 32. In the embodiment, the actuating component 33 includes a gas inlet plate 331, a piezoelectric plate 332, an insulation frame 333 and a conductive frame 334.

In the embodiment, the gas inlet plate 331 includes a plurality of inlet apertures 3311. The plurality of inlet apertures 3311 are arranged in a specific shape on a surface of the gas inlet plate 331. In the embodiment, the plurality of inlet apertures 3311 are arranged in a circular shape, and an actuation portion 3312 and a fixed portion 3313 are defined on the surface of the gas inlet plate 331 through the arranged shape of the plurality of inlet apertures 3311. The actuation portion 3312 is surrounded by the plurality of inlet apertures 3311, and the fixed portion 3313 is surrounding the periphery of the plurality inlet apertures 3311. In the embodiment, the plurality of inlet apertures 3311 are tapered to improve the air intake efficiency, and such structure is easy to enter and difficult to exit for the airflow, thereby result in the effect of preventing the phenomenon of backflow. Preferably but not exclusively, the number of the inlet apertures 3311 is an even number. In an embodiment, the number of the inlet apertures 3311 is forty-eight. In another embodiment, the number of the inlet apertures 3311 is fifty-two, but not limited thereto. Furthermore, in other embodiments, the plurality of inlet apertures 3311 are arranged in various shapes such as rectangle, square, circle and etc.

In the embodiment, the piezoelectric plate 332 is in a circular shape. The piezoelectric plate 332 is disposed on the actuation portion 3312 of the gas inlet plate 331. The piezoelectric plate 332 is corresponding in position to the actuation portion 3312 of the gas inlet plate 331. In the embodiment, as the plurality of inlet apertures 3311 are arranged in a circular shape, the actuation portion 3312 is defined as a circular shape, and the piezoelectric plate 332 is circular, too. In other embodiments, the arranged shape of the inlet apertures 3311 is selected from the group consisting of rectangle, square and circle, the shape of the actuation portion 3312 is adjusted according to the arrangement of the inlet apertures 3311, and the piezoelectric plate 332 is corresponding to the shape of the actuation portion 3312.

In the embodiment, the insulation frame 333 is disposed on the fixed portion 3313 of the gas inlet plate 331. The conductive frame 334 is disposed on the insulation frame 333. In addition, the conductive frame 334 includes a conducting electrode 3341 and a conducting pin 3342. The conducting electrode 3341 is electrically contacted with the piezoelectric plate 332. The conducting pin 3342 is externally connected to a wire. Preferably but not exclusively, the gas inlet plate 331 is formed by a conductive material and in electrical contact with the piezoelectric plate 332, and a contact point of the frame 32 is connected to another wire, thereby the driving circuit of the actuating component 33 is completed. In the embodiment, the driving signal of the gas transportation device 100 is transmitted through two wires. One wire connected to the conducting pin 3342 of the conductive 334 transmits the driving signal through the conducting electrode 3341 to the piezoelectric plate 332, and the other wire connected to the contact point of the frame 32 transmits the driving signal to the piezoelectric plate 322 through the attached contact between the frame 32 and the gas inlet plate 331, and the attached contact between the gas inlet plate 331 and the piezoelectric plate 322. Thereby, the piezoelectric plate 332 receives the driving signal (such as a driving voltage and a driving frequency) to deform, and the actuating component 33 is driven to generate the displacement in the reciprocating manner, as shown in FIG. 3B to FIG. 3C.

In the embodiment, actuating component 33 is in a circular shape. Preferably but not exclusively, the shape of the actuating component 33 is circular. Therefore, under the same peripheral size of the device, the actuating component 33 adopts a circular design. For the circular design of the actuating component 33, the gas inlet plate 331, the piezoelectric plate 332, the insulation frame 333 and the conductive frame 334 are circular.

Please refer to FIG. 1A, FIG. 1B, FIGS. 2A to 2C, FIGS. 3A to 3C and FIG. 4. In the embodiment, the gas outlet plate 21, the valve plate 22, the first plate 23, the second plate 31 and the actuating component 33 are stacked sequentially and disposed within the accommodation space 121 of the outer housing 12, and then the inlet cover 13 and the outer cover 11 are covered on the upper side and the lower side of the outer housing 12, so as to seal the accommodation space 121 and constitute the gas transportation device 100. In the embodiment, the gas inlet plate 331, the piezoelectric plate 332, the insulation frame 333 and the conductive frame 334 of the actuating component 33 are stacked sequentially and fixed on the frame 32, so that an inlet chamber 322 is formed between the actuating component 33, the frame 32 and the second plate 31. In addition, the first orifices 231 of the first plate 23 and the second orifices 311 of the second plate 31 are all located under the vertical projection area of the actuation portion 3312 of the gas inlet plate 331, and are vertically corresponding to the actuation portion 3312.

In the specific embodiment of the present disclosure, as shown in FIG. 3A to FIG. 3C, when the piezoelectric plate 332 receives the driving signal (such as a driving voltage and a driving frequency), the electrical energy is converted into the mechanical energy through the inverse piezoelectric effect. The deformation amount of the piezoelectric plate 332 is controlled according to the magnitude of the driving voltage, and the driving frequency is operated to control the deformation frequency of the piezoelectric plate 332. The deformation of the piezoelectric plate 332 drives the actuating component 33 to execute the gas transportation.

Figure 4:
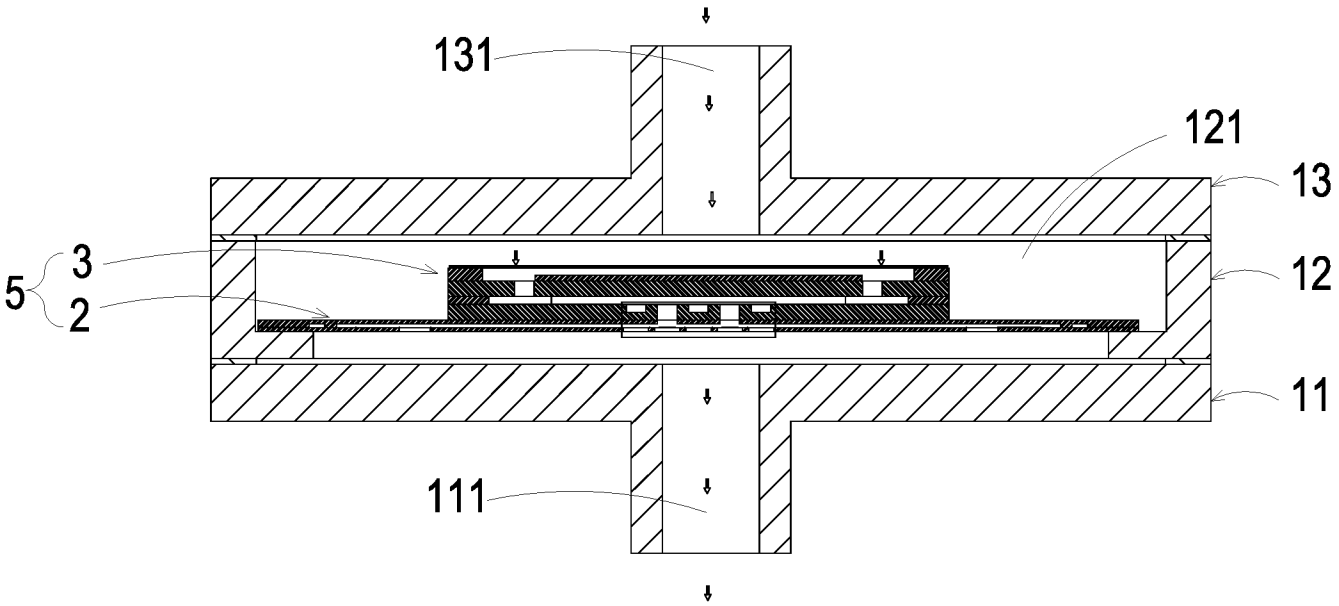

Please refer to FIG. 3B. When the piezoelectric plate 332 receives the driving signal to deform, the gas inlet plate 331 is driven to bend and displace upwardly. At this time, the volume of the inlet chamber 322 is increased, and a negative pressure is generated therein, so that the valve plate 22 is sucked to move upwardly and the first orifices 231 of the first plate 23 are sealed. At the same time, as shown in FIG. 4, the gas at the side of the inlet end 131 of the inlet cover 13 is sucked into the actuating component 33 to enter the inlet chamber 322. Please refer to FIG. 3C. When the piezoelectric plate 332 further receives the driving signal to deform again, the gas inlet plate 331 is driven to bend and displace downwardly, and the inlet chamber 332 is compressed. At this time, as shown in FIG. 4, the gas at the side of the inlet end 131 of the inlet cover 13 is sucked into the actuating component 33, and the gas in the inlet chamber 322 is pushed and transported downwardly through the second orifices 311 of the second plate 31 and the first orifices 231 of the first plate 23, respectively. As the kinetic energy is transmitted downwardly from the actuating component 33 to the gap G the kinetic energy can push the valve plate 22 to displace, so that the valve plate 22 is separated from the first orifices 231 and abuts against the gas outlet plate 21, thereby achieves the operation of opening the flow path. The gas is then transported downwardly through the valve openings 221 to the outlet apertures 211 of the gas outlet plate 21, and then flows through the outlet apertures 211 to be discharged out through the outlet end 111 of the outlet cover 11, as shown in FIG. 4. Thereafter, as shown in FIG. 3B, when the gas inlet plate 331 is driven by the piezoelectric plate 332 to bend and displace upwardly. The volume of the inlet chamber 322 is increased, and a negative pressure is generated in the inlet chamber 322, so that the valve plate 22 is sucked to move upwardly. As a result, the valve plate 22 seals the first orifices 231 to prevent the gas from flowing back to the inlet chamber 322 through the valve openings 221, the first orifices 231 and the second orifices 311. In addition, when the gas in the accommodation space 121 flows into the inlet chamber 322, the air pressure in the accommodation space 121 is lower than the air pressure outside the gas transportation device 100. In that, the gas outside the gas transportation device 100 is introduced into the accommodation space 121 through the inlet end 131, as shown in FIG. 4. When the piezoelectric plate 332 further receives the driving signal to deform, and drives the actuating component 33 to displace downwardly, the gas in the inlet chamber 322 is transported downwardly as described above, and finally discharged through the outlet end 111. Through performing the above steps continuously by applying the driving signal, the gas is inhaled through the inlet end 131 and discharged out through the outlet end 111 rapidly, so as to achieve the effect of high-flow amount.

In the embodiment, the valve body 2 is formed by the gas outlet plate 21, the valve plate 22 and the first plate 23. Preferably but not exclusively, the total flow rate of the fluid in the valve body 2 can be designed and realized according to the diameter or the number of the outlet apertures 211, the valve openings 221 and the first orifices 231. Please refer to Table 1. The relationships among the diameters and the numbers of the outlet apertures 211, the valve openings 221 and the first orifices 231 are listed in Table 1, so as to achieve the optimized effect of the high-flow gas transportation device 100.

TABLE 1

| | Diameter of the outlet aperture | | | | | | | |
|---|---|---|---|---|---|---|---|---|
| | 100 μm | 200 μm | 300 μm | 400 μm | 500 μm | 600 μm | 700 μm | 800 μm |
| Number of the outlet apertures | 49 | 49 | 36 | 36 | 25 | 25 | 25 | 25 |
| Number of the valve openings | 24 | 24 | 18 | 18 | 12 | 12 | 12 | 12 |
| Number of the first orifices | 20 | 20 | 18 | 18 | 12 | 10 | 10 | 10 |

Moreover, in the specific embodiment of the present disclosure, the valve body 2 is formed by the gas outlet plate 21, the valve plate 22 and the first plater 23. It has been considered that the valve plate 22 is a flexible membrane with the thickness ranged from 0.4 μm to 0.6 μm, and the gap G maintained between the valve plate 22 and the recessed portion 232 of the first plate 23 are ranged from 40 μm to 70 μm. Therefore, the piezoelectric plate 332 of the actuating component 33 is maintained at a working frequency ranged from 20 kHz to 22 kHz. Preferably but not exclusively, the working frequency of the piezoelectric plate 23 is 21 kHz, the amplitude of oscillation is maintained at 30 μm, and the valve plate 22 of 3 μm is disposed on the recessed portion 232 of the first plate 23 with the gap G ranged from 40 μm to 70 μm. In such configuration, the piezoelectric plate 332 is vibrated within the gap G to generate a unidirectional drainage of a rarefaction wave, so as to achieve the optimized effect of preventing the phenomenon of backflow and obtaining the maximum flow rate. It is important for maximizing valve performance to minimize the pressure drop that occurs as the gas flows through valve body 2.

In summary, the present disclosure provides a gas transportation device including a gas outlet plate, a valve plate, a first plate, a second plate and a circular actuating component, which are stacked and assembled in sequence. A valve body is configured by the valve plate, the first plate and the second plate collaboratively. The plurality of first orifices, the plurality of valve openings and the plurality of outlet apertures of the valve body are located below the actuation portion surrounded by the plurality of inlet apertures. When the piezoelectric plate drives the gas inlet plate to move, the gas is allowed to be downwardly transported rapidly, and the phenomenon of backflow is prevented through the structure that the plurality of first orifices and the plurality of valve openings are misaligned, so as to obtain a structure for providing high flow and avoiding the backflow. When an airflow is in the forward direction, the valve body is operated to open a flow path, and when the airflow is in the reverse direction, the valve body is operated to seal the flow path, thereby preventing the phenomenon of backflow, generating a unidirectional airflow and increasing the flow rate of the gas transportation device. The flow rate is increased substantially and the high-flow gas transportation device is achieved.

While the disclosure has been described in terms of the most practical and preferred embodiments, it is to be understood that the disclosure needs not be limited to the disclosed embodiments. On the contrary, it is intended to cover various modifications and similar arrangements included within the spirit and scope of the appended claims so as to encompass all such modifications and similar structures.

What is claimed is:

1. A gas transportation device, comprising:

an outer housing comprising an outlet cover, an outlet end, an accommodation space, an inlet cover and an inlet end, wherein the outlet cover is disposed on the outer housing, the outlet cover includes the outlet end, the inlet cover is disposed below the outer housing, the inlet cover includes the inlet end, the accommodation space is in fluid communication with the inlet end and the outlet end, and the outlet cover and the inlet cover are covered on an upper side and a lower side of the accommodation space, respectively;

a valve body being in a circular shape and comprising a gas outlet plate, a valve plate and a first plate stacked sequentially and disposed within the accommodation space, wherein the first plate comprises a recessed portion recessed from a surface of the first plate and formed a depth, the valve plate is located between the gas outlet plate and the first plate, and a gap is maintained between the valve plate and the recessed portion of the first plate, so that the valve plate is allowed to displace in the gap and control a flow path in the valve body, wherein the gas outlet plate comprises a plurality of outlet apertures, the first plate comprises a plurality of first orifices, the valve plate comprises a plurality of valve openings, the plurality of valve openings are misaligned with the plurality of first orifices, and the plurality of valve openings are corresponding in position to the plurality of outlet apertures; and an actuator being in a circular shape, stacked on the valve body, and comprising a second plate, a frame and an actuating component, wherein the second plate is stacked and disposed on the first plate of the valve body, the second plate comprises a plurality of second orifices, and the plurality of second orifices are corresponding in position to the plurality of first orifices, wherein the frame is stacked and disposed on the second plate, wherein the actuating component is stacked and disposed on the frame;

wherein when the actuator is driven, since the plurality of first orifices and the plurality of valve openings are misaligned, the valve body is operated to open the flow path when an airflow is in a forward direction, and the valve body is operated to seal the flow path when the airflow is in a reverse direction, wherein the actuating component comprises a gas inlet plate, a piezoelectric plate, an insulation frame and a conductive frame, wherein the gas inlet plate comprises a plurality of inlet apertures, wherein an actuation portion and a fixed portion are defined on a surface of the gas inlet plate through the positions of the plurality of inlet apertures, the actuation portion is surrounded by the plurality of inlet apertures, and the fixed portion is surrounding the periphery of the plurality inlet apertures, wherein the piezoelectric plate is disposed on the actuation portion of the gas inlet plate, wherein the insulation frame is disposed on the fixed portion of the gas inlet plate, wherein the conductive frame is disposed on the insulation frame, wherein the conductive frame includes a conducting electrode and a conducting pin, the conducting electrode is electrically contacted with the piezoelectric plate, the conducting pin is externally connected to a wire, the gas inlet plate is formed by a conductive material and in electrical contact with the piezoelectric plate, and a contact point of the frame is connected to another wire, thereby the driving circuit of the actuating component is completed.

2. The gas transportation device according to claim 1, wherein the plurality of first orifices, the plurality of valve openings and the plurality of outlet apertures of the valve body are located below the actuation portion surrounded by the plurality of inlet apertures, wherein when the piezoelectric plate drives the gas inlet plate to move, through the structure that the plurality of first orifices and the plurality of valve openings are misaligned, the valve body is operated to open the flow path when the airflow is in the forward direction, and the valve body is operated to seal the flow path when the airflow is in the reverse direction.

3. The gas transportation device according to claim 1, wherein a ratio of the gap to the thickness of the first plate is ranged from 1:2 to 2:3.

4. The gas transportation device according to claim 1, wherein the gap is ranged from 40 μm to 70 μm.

5. The gas transportation device according to claim 1, wherein the valve plate is a flexible membrane, and the thickness of the valve plate is ranged from 0.4 μm to 0.6 μm.

6. The gas transportation device according to claim 1, wherein the valve plate is a polyimide membrane.

7. The gas transportation device according to claim 1, wherein the diameter of the valve opening is greater than the diameter of outlet aperture.

8. The gas transportation device according to claim 1, wherein the diameter of the valve opening is equal to the diameter of outlet aperture, and the diameter of the first orifice is equal to the diameter of the second orifice.

9. The gas transportation device according to claim 1, wherein the plurality of inlet apertures are tapered.

10. The gas transportation device according to claim 1, wherein the number of the inlet apertures is an even number.

11. The gas transportation device according to claim 10, wherein the number of the inlet apertures is forty-eight or fifty-two.

12. The gas transportation device according to claim 1, wherein the plurality of inlet apertures are arranged in a rectangular shape on a surface of the gas inlet plate.

13. The gas transportation device according to claim 1, wherein the plurality of inlet apertures are arranged in a square shape on a surface of the gas inlet plate.

14. The gas transportation device according to claim 1, wherein the plurality of inlet apertures are arranged in a circular shape on a surface of the gas inlet plate.

15. The gas transportation device according to claim 2, wherein the actuation portion is circular, and the piezoelectric plate is circular.

16. The gas transportation device according to claim 1, wherein the gas outlet plate, the first plate and the second plate are a metallic plate, respectively.

17. The gas transportation device according to claim 2, wherein the piezoelectric plate of the actuating component is maintained at a working frequency ranged from 20 kHz to 22 kHz.

18. The gas transportation device according to claim 1, wherein the diameter of the outlet aperture is 100 μm or 200 μm, the number of the outlet apertures is forty-nine, the number of the valve openings is twenty-four, and the number of the first orifices is twenty.

19. The gas transportation device according to claim 1, wherein the diameter of the outlet aperture is 300 μm or 400 μm, the number of the outlet apertures is thirty-six, the number of the valve openings is eighteen, and the number of the first orifices is eighteen.

20. The gas transportation device according to claim 1, wherein the diameter of the outlet aperture is 500 μm, the number of the outlet apertures is twenty-five, the number of the valve openings is twelve, and the number of the first orifices is twelve.

21. The gas transportation device according to claim 1, wherein the diameter of the outlet aperture is selected from the group consisting of 600 μm, 700 μm and 800 μm, the number of the outlet apertures is twenty-five, the number of the valve openings is twelve, and the number of the first orifices is ten.

* * * * *